United States Patent [19]

Orbeck

[11] Patent Number: 4,749,824

[45] Date of Patent: Jun. 7, 1988

[54] HIGH VOLTAGE INSULATORS

[75] Inventor: Tor Orbeck, Midland, Mich.

[73] Assignee: Dow Corning Corporation, Midland, Mich.

[21] Appl. No.: 9,171

[22] Filed: Jan. 30, 1987

[51] Int. Cl.[4] ..... H01B 17/02; H01B 17/50; H01B 3/46

[52] U.S. Cl. ..... 174/179; 174/209; 174/212; 428/447; 524/430; 524/588

[58] Field of Search ..... 174/137 A, 137 B, 179, 174/209, 211, 212; 428/447

[56] References Cited

U.S. PATENT DOCUMENTS

| | | | |
|---|---|---|---|
| 3,511,698 | 5/1970 | Talcott | 174/209 X |
| 3,965,065 | 6/1976 | Elliott | 524/430 |
| 4,001,128 | 1/1977 | Penneck | 524/430 X |
| 4,174,464 | 11/1979 | Kawaguchi et al. | 174/212 |
| 4,177,322 | 12/1979 | Homan et al. | 428/447 |
| 4,217,466 | 8/1980 | Kuhl | 174/209 |
| 4,246,696 | 1/1981 | Bauer et al. | 29/631 |
| 4,476,155 | 10/1984 | Niemi | 174/137 B X |
| 4,505,033 | 3/1985 | Wheeler | 29/631 |

FOREIGN PATENT DOCUMENTS

| | | | |
|---|---|---|---|
| 1057676 | 5/1959 | Fed. Rep. of Germany | 174/212 |
| 372719 | 12/1963 | Switzerland | 174/212 |
| 893137 | 4/1962 | United Kingdom | 174/212 |
| 915052 | 1/1963 | United Kingdom | 174/179 |
| 1292276 | 10/1972 | United Kingdom | 174/179 |
| 1601379 | 10/1981 | United Kingdom | 174/179 |

OTHER PUBLICATIONS

"High Surface Resistance Protective Coatings for High Voltage Insulators", Presented by R. G. Niemi and T. Orbeck at the IEEE Power Engineering Society Summer Meeting in San Francisco, Calif., on Jul. 9–14, 1972.

"Silicone Elastomer for Composite Fiberglass Reinforced High Voltage Insulators", Presented by P. Robert, J. Davis, and J. Dexter; Presented in Russia, in Jun. of 1977.

"Field Experience and Testing of New Insulator Types in South Africa", Presented by H. Weihe, R. E. Macey, and J. P. Reynders; at the 1980 Session of the Int'l Conf. on Large High Voltage Electric Systems.

"Silicone Elastomer Insulators for High Voltage Outdoor Applications on British Rail", Presented by J. C. G. Wheeler, A. Bradwell, M. J. Dams, and I. Sibbald; at a BEMA Conference in May, 1982.

*Primary Examiner*—Laramie E. Askin

*Attorney, Agent, or Firm*—Edward C. Elliott

[57] ABSTRACT

A high performance, high voltage electrical insulator, for use at greater than 15 Kv in wet, contaminated conditions, is designed to give a minimum surface area while maintaining a low leakage current by specifying the ratios of shed diameter to shed pitch, leakage distance between support fittings to the straight line distance between support fittings, and the shed diameter to the support rod diameter. Through the use of specified silicone elastomeric compositions, or through the use of silicone compositions meeting specified electrical properties, an insulator meeting the design specifications is shown to be a useful high voltage insulator.

10 Claims, 1 Drawing Sheet

HIGH VOLTAGE INSULATORS

BACKGROUND OF THE INVENTION

1. Field of the Invention

This invention is related to high voltage electrical insulators intended for operation at voltages of greater than 15 kilovolts.

2. Background Information

High voltage transmission lines have historically been insulated with porcelain and glass insulators. In order to operate at the reliability level required, these insulators are designed to operate at a low electrical stress level. For use in clean atmospheres the stress level is generally about 1 kV per inch. In areas where the insulator is subjected to contamination, as along a sea coast or in an industrial area, the stress level is ordinarily on the order of 0.5 kV per inch or less, resulting in a large and bulky insulator. These insulators are very heavy and still develop high level leakage current and dry band arcing, which leads to flashover. In practice, utilities often carry out extensive insulator maintenance such as washing and greasing, or coating with a room temperature curing silicone rubber, of the insulators at regular intervals of time. In some severe applications, utilities have gone to the use of resistance grading of the insulator to give heated insulators to avoid excessive leakage currents.

Other types of insulators have been proposed for these types of uses, such as those below as described in various patents and scientific literature.

United Kingdom Pat. No. 915,052, published Jan. 9, 1963, teaches an electrical insulator comprising a rod or tube of resin-bonded glass fiber having a closely-fitting, longitudinally continuous covering of a relatively non-tracking elastomeric polymeric insulating material, extending over the whole or a major part of the length of the rod or tube.

U.S. Pat. No. 3,511,698, issued May 12, 1970, to Talcott taught weatherable insulators comprising a rigid resin base member and a coating over the surface of said base member of at least ten mils thickness of cured, organopolysiloxane elastomer which comprised a silicone elastomer stock containing SiH groups and Si-alkenyl groups, and a platinum catalyst.

United Kingdom Pat. No. 1,292,276, published Oct. 11, 1972, discloses an insulator which comprises a central support of which the outer surface comprises a non-tracking electrically insulating material and at least one shed installed on the central support. The sheds are heat-shrinkable.

U.S. Pat. No. 3,965,065, issued June 22, 1976 to Elliott teaches a method of preparing an improved elastomer-forming composition which comprises forming a mixture comprising an organopolysiloxane which is convertible to the solid elastic state and aluminum hydrate, and heating the mixture at a temperature of at least 100° C. for a time of at least 30 minutes.

The composition is taught to be particularly useful for the fabrication of electrical insulation having improved resistance to electric arcing and tracking.

A filler system for polymers which provides high voltage insulation is described by Penneck in U.S. Pat. No. 4,001,128, issued Jan. 4, 1977. The filler system utilizes a combination of alumina trihydrate and a chemically treated silica filler.

A rod-type insulator having improved withstand voltage characteristics under a contaminated condition is described in U.S. Pat. No. 4,174,464, issued Nov. 13, 1979. The design specifies that the leakage distance per shed divided by the pitch between the adjoining sheds is between 3.8 and 5.0 and that the leakage distance between a given point on a lower surface of one of the adjoining sheds and another given point on an upper surface of the other opposing shed divided by the distance between the given points is between 4.5 and 6.0. The lower surface of each shed has coaxial ribs forming an undulating surface.

German Pat. No. 2,650,363, issued Sept. 10, 1985 was published Nov. 17, 1977. Its U.S. equivalent is U.S. Pat. No. 4,217,466, issued Aug. 12, 1980. It teaches that the rod used in an insulator must be made from a non-saponifiable resin and the screens used must be a moisture-repellent, non-saponifiable polymer and that there must be an intermediate layer of material between the rod and the screens to protect the rod.

A process for forming open-air compound insulators is taught in U.S. Pat. No. 4,246,696, issued Jan. 27, 1981 to Bauer and Kuhl. A pre-fabricated glass fiber rod treated with silane has a rubber layer extruded over it, then after strengthening the rubber layer, prefabricated screens are bonded on by vulcanization. Their discussion of the prior art teaches the importance of the screens.

United Kingdom Pat. No. 1,601,379, published Oct. 28, 1981, teaches that for high voltage insulators, and particularly very high voltage insulators, the surface creepage distance is at least equal to 2 and preferably 3 or even higher than 3 times the straight line distance between a live conductor and ground. This is particularly true when insulators are intended for use under polluted and very polluted conditions.

Another method of assembling an insulator with sheds or screens is taught in U.S. Pat. No. 4,505,033, issued Mar. 19, 1985, to Wheeler. Sheds are either molded on or placed over a sheath of unvulcanized elastomer on a core, then the assembly is vulcanized.

In addition to the teachings represented by the above patent references, there has been a great deal of scientific literature published over the years describing insulator applications in both test applications and in commercial applications which have been closely monitored to determine the operation of the insulators. For example, Niemi and Orbeck described their concept of the properties they felt an insulation material should have and means for measuring these properties in an article, "High Surface Resistance Protective Coatings For High Voltage Insulators", presented at the IEEE Power Engineering Society Summer Meeting in San Francisco, CA, on July 9–14, 1972. They discuss a test in which an insulator is stressed at a level of 6.7 kv/in for a time period of up to 8 hours. A paper by Robert, Davis, and Dexter, presented in Russia in June of 1977 discusses the tests performed upon a silicone elastomer suggested for use in manufacturing insulators. They conclude that the silicone elastomer offers the best combination of physical, electrical, and surface properties to enable it to perform in the widest variety of environments.

High voltage polymeric insulators are normally operated under stresses in the range of from 0.25 kv/in to 0.75 kv/in as is recorded in the paper by Weihe, Macy, and Reynders, "Field Experience and Testing Of New Insulator Types in South Africa", presented at the 1980 session of the International Conference on Large High Voltage Electric Systems. A silicone insulator is described in "Silicone Elastomer Insulators For High Voltage Outdoor Applications on British Rail", a paper by Wheeler, Bradwell, Dams, and Sibbald at a BEMA Conference in May, 1982, that is a resin bonded glass fiber rod covered with a layer of silicone elastomer bonded to the rod and with end fittings adhesively bonded on each end. It appears that the insulators are 1070 mm (42.1 inches) long between end fittings and are used at 25 kv 50 Hz, giving a stress level of 0.6 kv/in.

The initial testing of new polymer based insulators indicated higher performance capability when compared to porcelain; they could operate at higher stress levels. Longer term service and test experience has shown that with aging and contamination, the polymer insulators such as are taught in the above references lose their initial voltage capability and in many cases are not able to provide the same service as porcelain and glass insulators. Current practice often recommends that polymer insulators to be used only for clean service conditions and with designed surface stresses of 0.5 to 0.7 kv/in. Operation in the field at higher stress levels has shown failure due to tracking and flashover under wet conditions. There is a need for polymer insulators capable of operating under wet, contaminated service conditions at higher stress levels exceeding 1.0 kv/in for extended periods of time.

SUMMARY OF THE INVENTION

A high voltage electrical insulator for use with voltages in excess of 15 kilovolts line to ground comprises a non-conducting, fiber reinforced polymeric support rod, metal support fittings at each end of the support rod, and a continuous silicone elastomeric cover securely bonded to the support rod and to the metal fittings. The cover is shaped to provide at least one shed and has certain specified geometrical ratios which control its shape. The cover is comprised of a specified cured silicone elastomeric composition, which has been shown to provide electrical stability even under high electrical stress and in wet, highly contaminated environments.

DESCRIPTION OF THE INVENTION

Figure 1:
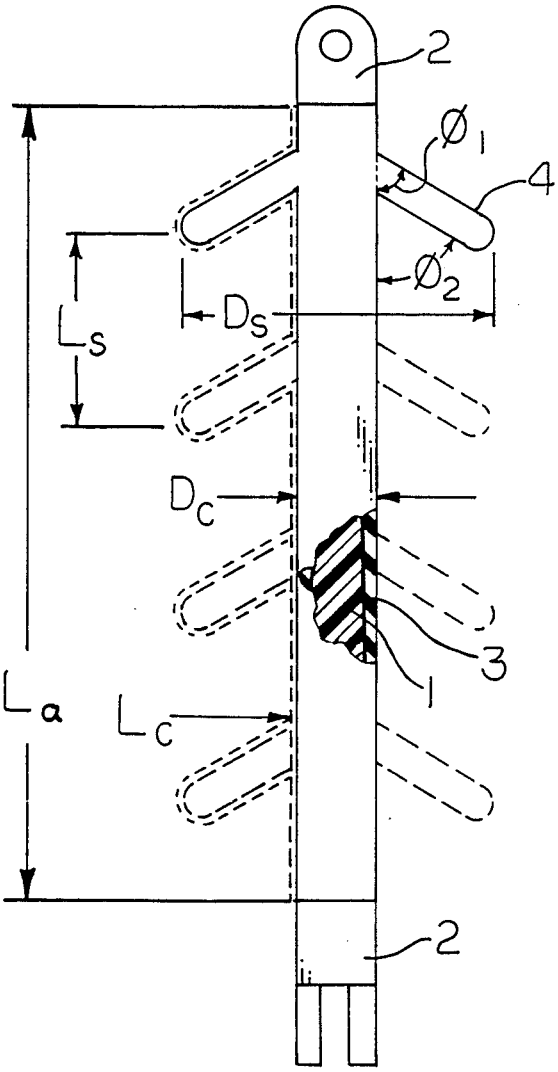
FIG. 1 shows a typical insulator of this invention having one shed as required. Also shown are optional sheds. The dimensions used to define the shape of the insulator are shown.
Figure 2:
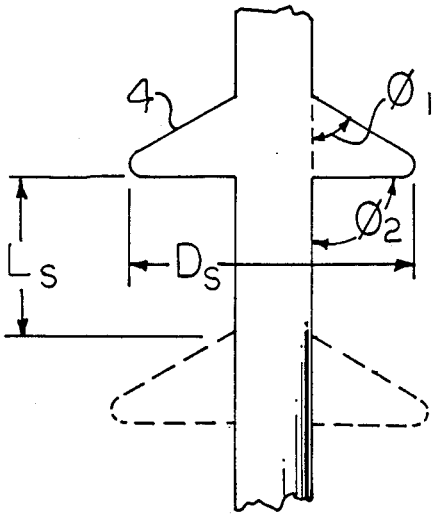
FIG. 2 shows an insulator with an alternative shed shape.

This invention relates to an electrical insulator for use at high voltages. The uniquely arc-resistant silicone material used, combined with a design optimizing the voltage stability, provides an insulator with excellent performance under wet, contaminated service conditions.

The length of an insulator is determined by the operating voltage and potential impulse over-voltage caused by switching surges and lightning strikes. The surface of the insulator is shaped to give minimum leakage currents and to reduce the probability of flashover caused by dry-band arcing. The design takes advantage of the surface properties of the silicone elastomeric composition used to make the surface of the insulator. The insulator suppresses leakage current over its surface during conditions of use so that the electrical arcing on the polymer surface is suppressed or kept at a low level throughout the service life of the insulator. Arc resistance is defined as the ability to resist tracking and erosion when subjected to a fog chamber test in which the fog conductivity is 1000 microsiemens and the electrical stress is at a level of 1.5 kV per inch of sample length.

This invention relates to a high performance, high voltage electrical insulator, for use with voltages in excess of 15 kilovolts line to ground in an outdoor environment, comprising (1) a non-conducting, fiber reinforced, polymeric support rod, (2) metal support fitting attached securely to each end of the support rod, and (3) a continuous, arc-resistant silicone elastomeric cover securely bonded to the support rod and each metal support fitting, the cover being shaped to provide at least one shed and so that the following ratios are present, $$\frac{D_s}{L_s} \text{ equal or less than } 1.5$$

$$\frac{L_c}{L_a} \text{ equal or less than } 1.7$$

$$\frac{D_s}{D_c} \text{ equal or less than } 3$$

where $D_s$ is shed diameter, $L_s$ is the minimum distance between adjacent sheds, $L_c$ is leakage distance between the support fittings, $L_a$ is straight line distance between the support fittings, and $D_c$ is diameter of the cover over the support rod, the silicone elastomeric cover comprising a cured composition resulting from a composition comprising a mixture of (a) from 70 to 90 parts by weight of dimethylvinylsiloxy endblocked polydimethylsiloxane having a Williams plasticity number of greater than 50, (b) from 10 to 30 parts by weight of dimethylvinylsiloxy endblocked polydiorganosiloxane having about 98 mol percent dimethylsiloxane units and 2 mol percent methylvinylsiloxane units and a Williams plasticity number of greater than 25, (c) from 13 to 17 parts by weight of fumed silica having a surface area of greater than 50 $m^2/g$, and a treated surface which prevents reaction with (a) and (b), (d) from 1.5 to 2.5 parts by weight of hydroxyl endblocked polydiorganosiloxane having methyl and vinyl radicals and having about 10 weight percent vinyl radical and about 16 weight percent hydroxyl radical, and (e) from 90 to 220 parts by weight of aluminum trihydrate, the mixture having been heated at a temperature of at least 100° C. for a time of at least 30 minutes.

An electrical insulator for use on high voltage transmission lines is required to operate without maintenance, or little maintenance, for long periods of time, many years in fact, without failing in its job of insulating the conductor from ground. This must be done in the face of all kinds of weather and in spite of weather's harsh effects upon the insulator. In the development of such insulators, the use of test methods is required in orders to reduce the time required to evaluate an insulator. Tests have been devised in which insulators and insulator materials can be exposed to viable conditions of dry and wet, contaminated conditions in a relatively short period of time which expose the material to the total stresses found in service over a much longer period of time. Work on such tests has resulted in a means for designing an insulator which can be tested in a short period of time with the expectation that an insulator which passes the required tests will also function in actual use for the required number of years.

The insulator of this invention is a high performance, high voltage insulator designed to operate at line to ground voltages of greater than 15 kV, such as are found in transmission systems. In order to take advantage of the particular physical and electrical properties of the high arc-resistant, low leakage current silicone elastomer used to form the outer surface of the insulator, the insulator can be designed to have an average surface electrical stress of greater than 1.0 kV/inch. That is, the design voltage of the transmission line, in kilovolts, divided by the length of the leakage distance over the surface of the insulator between end fittings in inches, is greater than 1.0 kV/inch. The voltage can be as great as 1.5 kV/inch. This is equivalent to 60 volts per millimeter. This level of voltage stress is considerably higher than that normally used for designing transmission line insulators. This is the meaning of "high performance" in this application. Furthermore, the insulator is designed to have at least one shed present, but makes use of a minimum number of sheds so as to make as simple and light an insulator as is possible by taking advantage of the unique electrical properties of the silicone elastomer used to form the sheds.

The shape of the outer surface of the insulator between the metal end fittings is such that the following ratios are present, $$\frac{D_s}{L_s} \text{ equal or less than } 1.5$$

$$\frac{L_c}{L_a} \text{ equal or less than } 1.7$$

$$\frac{D_s}{D_c} \text{ equal or less than } 3$$

where $D_s$ is shed diameter, $L_s$ is the minimum distance between adjacent sheds, $L_c$ is leakage distance between the support fittings, $L_a$ is straight line distance between the support fittings, and $D_c$ is diameter of the cover over the support rod. These dimensions are illustrated in FIG. 1. The ratio of $D_s/L_s$ equal or less than 1.5 means that the diameter of the shed must be equal to or less than 1.5 times the distance between the sheds. The ratio $L_c/L_a$ equal or less than 1.7 means that the leakage distance over the surface of the insulator between the support fittings is equal to or less than 1.7 times the distance between the support fittings. The ratio $D_s/D_c$ equal or less than 3 means that the diameter of the sheds is equal to or less than 3 times the diameter of the support rod cover. Using the material specified for this insulator, it has been found that the insulator sheds do not need to be of any greater diameter. By limiting the diameter of the sheds, the surface area of the insulator is limited. For a given potential across the insulator, the smaller the surface area, the smaller the leakage current will be. When dry bands are formed on an insulator surface, arcing occurs. The intensity of the arc is dependent on the leakage current feeding the arc. If the leakage current is controlled at a low level, the arc energy will be low, and the potential for damage or flashover is low. By maintaining the low leakage currents with a special silicone elastomer with unique surface properties, and keeping the surface area at a minimum, the surface leakage current of the insulator between the fittings is maintained at a minimum.

The structural strength of the insulator is derived from a fiber reinforced polymeric support rod, part 1 in FIG. 1. The fibers are electrically non-conducting. The fibers are continuous from one end of the rod to the other and are of the maximum amount able to be properly impregnated with resin to give the maximum tensile strength. The fibers are treated on their surface with a sizing or primer which is compatible with the resin used to give a strong, void-free bond between the fibers and the resin. The preferred fibers are glass. The fibers are bound together in a void-free manner with a rigid resin polymer. The preferred resins are of the polyester or epoxy types, both of which can be processed without solvent so that a void-free cured rod can be produced, as by the pultrusion process. To function properly, the cured rod must be void free and have a smooth, crack free surface. Any cracks or voids in the rod become weak points when subjected to the electrical field set up around a high voltage insulator.

A metal end fitting is securely attached to each end of the core rod by swaging, use of metal wedges, adhesives or combination of methods. The metal end fittings are part 2 of FIG. 1. The method of attachment of the end fittings to the rod is well known in the art and is not a part of this invention. The end fitting is attached to the rod so that under test to failure, the rod maintains a load well above the design load of the insulator.

Because the core rod cannot provide the required electrical insulation characteristics for the insulator under outdoor conditions of wet contaminants, it is covered with a void-free coating of silicone elastomer, part 3 in FIG. 1. The coating is molded over the core rod with the end fittings attached to completely cover the rod and the junction to the end fittings. The rod and end fittings are primed so that the silicone elastomer bonds to the rod and to the fittings so that there are no voids present in the interface between the silicone elastomer coating and the rod or end fitting where moisture could penetrate.

The insulator of this invention is required to have at least one shed so that the surface leakage distance between the metal support fittings is greater than the straight line distance between them. The shed is part 4 of FIG. 1. A preferred configuration is an insulator having two sheds, generally located near each end of the insulator. Another preferred configuration has a multitude of sheds, generally spaced equidistant from each other and the metal support fittings. The preferred sheds have an upper and lower surface which are approximately parallel. Preferably the lower surface of the shed is planar; that is, it does not have ribs as are commonly found on high voltage insulators. In the interest of ease of molding there is usually a slight taper to the surfaces so that the mold can be easily removed after pressing and curing. It is preferred that the upper shed surface be at an angle, $\phi_1$ of FIG. 1, of at least 30 degrees to the center line of the insulator core, with the surface pointing downward when the core is in a vertical direction. An upper surface at a downwardly pointing angle allows water on the surface to flow down the surface and off the outer perimeter of the shed. Such moisture flow tends to make the insulator self cleaning. Because of the water repellant nature of the silicone elastomer surface, an angle of greater than 30 degrees is sufficient to cause such a downward flow of water drops which form on the insulator surface from rain or from fog and dew conditions. The under surface of the insulator shed can be at an angle, $\phi_2$ of FIG. 1, of from 30 to less than 90 degrees from the insulator core. The less this angle is, the more likely it is that any water forming on this surface will run off. Of course, the angle for the under surface must be greater than the angle of the upper surface so that the shed does not have a thickness at the periphery greater than that at the core. Because the leakage distance over the surface of the insulator does not need to be increased over that obtained by a flat surface, there is no need for ribs on the under surface of the sheds, as are commonly found on high voltage insulators. The absence of these ribs also reduces the surface area of the insulator, thereby decreasing the leakage current across the insulator.

The silicone elastomeric coating comprising the surface of the insulator is a cured elastomer resulting from curing a composition comprising a mixture of (a) from 70 to 90 parts by weight of dimethylvinylsiloxy endblocked polydimethylsiloxane having a Williams plasticity number of greater than 50, (b) from 10 to 30 parts by weight of dimethylvinylsiloxy endblocked polydiorganosiloxane having about 98 mol percent dimethylsiloxane units and 2 mol percent methylvinylsiloxane units and a Williams plasticity number of greater than 25, (c) from 13 to 17 parts by weight of fumed silica having a surface area of greater than 50 $m^2/g$, and a treated surface which prevents reaction with (a) and (b), (d) from 1.5 to 2.5 parts by weight of hydroxyl endblocked polydiorganosiloxane having methyl and vinyl radicals and having about 10 weight percent vinyl radical and about 16 weight percent hydroxyl radical, and (e) from 90 to 220 parts by weight of aluminum trihydrate, the mixture having been heated at a temperature of at least 100° C. for a time of at least 30 minutes.

A preferred silicone elastomeric coating comprising the surface of the insulator is a specific composition found to have the unique physical and electrical properties required to enable one to make an electrical high voltage insulator as is herein described. The composition includes two different polydimethylsiloxane polymers, both having dimethylvinylsiloxane endblocking. Polymer (a) has a Williams plasticity number of greater than 50, with a preferred polymer having a viscosity which gives a Williams plasticity number of about 80. The other polymer, (b), has vinyl radicals present as endblockers and also along the chain in an amount sufficient to give about 2 mol percent vinyl radicals in the polymer. The additional vinyl polymer gives a higher crosslink density to the cured polymer. Polymer (b) has a viscosity which gives a Williams plasticity of greater than 25 with a preferred Williams plasticity of about 28. The amount of polymer (a) is from 70 to 90 parts by weight with from 80 to 90 parts preferred, and 85 parts by weight most preferred. The amount of polymer (b) is from 10 to 30 parts by weight with from 10 to 20 parts by weight preferred, and 15 parts by weight most preferred.

The composition contains from 13 to 17 parts by weight of fumed silica having a surface area of greater than 50 $m^2/g$, and a treated surface which prevents reaction with (a) and (b). The fumed silica can be any of the different types of fumed silica normally used as reinforcement in silicone rubber. The silica has a surface treated to prevent reaction with the polymers (a) and (b). The reaction of silicone polymer with silica is the known reaction which causes the uncured mixture to crepe upon aging. The silica can be pretreated as with hexamethyldisilazane, or it can be treated in situ by including a hydroxy containing fluid such as ingredient (f), hydroxyl endblocked polydimethylsiloxane fluid having a viscosity of about 0.04 Pa·s at 25° C. and about 4 weight percent silicon-bonded hydroxyl radicals, to treat the silica surface. The preferred amount is from 7 to 9 parts by weight. Preferred is fumed silica having about 250 $m^2/g$ surface area that is treated in situ, with 15 parts by weight of the silica and 8 parts by weight of the in situ treating agent (f) most preferred.

Ingredient (d) is felt to impart a tougher cured product by introducing more crosslinking in a non-homogenous manner. It is present in from 1.5 to 2.5 parts by weight, with 2 parts by weight most preferred.

An essential ingredient in the composition is aluminum trihydrate (e), in an amount of from 90 to 220 parts by weight. Preferred is an amount of from 180 to 220 parts, with 200 parts by weight most preferred. The aluminum hydrate is known to improve the arc resistance of silicone elastomers. In the composition of this invention, it is necessary that the aluminum hydrate be added to the mixture in the preparation container before the mixture is subjected to heating at a temperature of at least 100° C. for a time of at least 30 minutes.

The silicone surface of the insulator of this invention is a silicone elastomeric material which is required to have the following performance capabilities when evaluated as 1 inch diameter rods having a length of 6 inches between test electrodes:

In a fog chamber test, stressed at 1.5 kV/inch, conductivity of 200 microSiemens per centimeter, and 30 cycles of 16 hours voltage exposure and 8 hours recovery, 1. greater than 50 hours to establish leakage current of greater than 2 milliamperes,
2. greater than 100 hours to establish discharge pulses of greater than 15 milliamperes,
3. total accumulated current during the 30 cycles of less than 7000 coulombs, and
4. no flashover during the test.

In a fog chamber test, stressed at 1.5 kV/inch, conductivity of 1000 microSiemens per centimeter, and 30 cycles of 16 hours voltage exposure and 8 hours recovery, 1. no tracking on the surface,
2. no flashover of the rod,
3. less than 4 percent weight loss, and
4. less than 1 percent foreign contaminants accumulated on the surface (determined by ESCA test).

When evaluated as molded slabs having a thickness of about ¼ inch, the silicone elastomeric material has the following property:

In a track resistance test, in accordance with ASTM D 2303, run at 4.5 Kv and 8 strokes per minute, 1. greater than 1000 minutes to failure.

A silicone elastomer composition meeting the above requirements, when tested as shown, can be used as the silicone elastomeric cover of the insulator of this invention.

A complete insulator, as in FIG. 1 for example, when tested in a fog chamber and stressed at 1.5 kV/inch under a fog conductivity of 200 microsiemens per centimeter, should suppress leakage currents to a level of less than 2 milliamperes for more than 10 hours; have no leakage pulses exceeding 50 milliamperes during a total test period of 250 hours; have a total accumulated current of less than 50 coulombs.

The silicone elastomeric material under test is molded into 1 inch diameter test rods, using the same molding conditions that will be used to mold the final insulator. A suitable fog chamber and test procedure is described below in Example 4.

The surface composition of the insulator is determined using an analytical technique known as X-ray-induced photoelectron spectroscopy, which is widely known as ESCA: Electron Spectroscopy for Chemical Analysis. In this technique, low energy electrons emitted by the specimen are analyzed to provide composition information in the one-to-ten atom layer region near the surface. A solid sample in a high vacuum system is irradiated with a high flux of X-rays. Core (inner-shell) electrons are ejected from all atoms in the sample, and analysis of the kinetic energy of these photo-ejected electrons provides information upon a number of important properties. The precise location of the measured peaks identifies not only the elements present, but also their chemical environment. This test determines the nature of a surface by its chemical composition.

The track resistance test referred to above is an ASTM D 2303 test of the American Society for Testing and Materials. The current edition is found in section 10 of the Annual Book of ASTM Standards. The contaminant pump is operated at a rate of 8 strokes per minute, resulting in a flow of 0.60 ml/min. The voltage is set at 4.5 kV. The sample is tested under the time-to-track method. The insulator material is required to withstand greater than 1000 minutes without tracking or severe erosion.

The following examples are included for illustrative purposes only and should not be construed as limiting the invention, which is properly set forth in the appended claims. All parts are parts by weight.

EXAMPLE 1

Vertical suspension insulators of an ethylene-propylene elastomer formulation and of a silicone formulation, with similar filler contents, were prepared and tested under use conditions to compare their relative resistance to wet contamination conditions under voltage stress.

The insulators were designed for use at 115 kV. They were tested at 66 kV, line to ground, under heavily contaminated conditions. The insulators had a straight line distance between the end fittings of 37.75 inches. There were 9 sheds having a diameter of 4.5 inches and 8 sheds having a diameter of 3.5 inches. A smaller shed was located between each of the larger sheds. The minimum distance between sheds was 1 inch. The upper surface of the larger sheds had an angle of about 55 degrees to the core while the smaller sheds had an angle of about 45 degrees. The lower surface of each shed was approximately parallel to the upper surface. The leakage distance between the support fittings was 67.5 inches.

A silicone elastomer composition was prepared using a procedure falling under the method used to make insulators of this invention. The composition was prepared by mixing in a dough mixer, 85 parts of dimethylvinylsiloxy endblocked polydimethylsiloxane having a Williams plasticity number of about 80, 15 parts of dimethylvinylsiloxy endblocked polydiorganosiloxane having about 98 mol percent dimethylsiloxane units and 2 mol percent methylvinylsiloxane units and a Williams plasticity number of about 28, 8 parts of hydroxyl endblocked polydimethylsiloxane fluid having a viscosity of about 0.04 Pa·s at 25° C. and about 4 weight percent silicon-bonded hydroxyl radicals, 2 parts of hydroxyl endblocked polydiorganosiloxane having methyl and vinyl radicals and having about 10 weight percent vinyl radical and about 16 weight percent hydroxyl radical, 15 parts of fumed silica having a surface area of about 250 $m^2/g$, and 200 parts of aluminum hydrate, then mixing and heating to about 175° for about one half hour. After cooling, 100 parts of the composition was mixed with 0.45 part of catalyst of 50 percent 2,5 bis(-tert-butylperoxy)-2,5-dimethyl hexane in powdered carrier.

An ethylene-propylene-dimer composition containing about 95 parts by weight of polymer and about 180 parts by weight of aluminum trihydrate filler was used to prepare comparative insulators.

The insulators were installed in a test station under a test voltage of 66 kV, line to ground. The insulators were continuously stressed electrically. The test station was located along the seacoast, where it was subjected to periodic fog, as well as salt contamination. Standard porcelain suspension insulators operating at 0.5 kV/inch failed by flashover in less than one year of testing. At 1 kV/inch, they generally failed in 1 to 3 months. The insulators were periodically inspected for damage. A record was also maintained as to whether there was a flashover of the insulator. The observations are summarized in Table I. The results show that the silicone elastomer insulator performed much better than the similar insulator made of ethylene-propylene elastomer.

The insulators made of ethylene-propylene-dimer did not function satisfactorily in that they flashed over many times during the test. The silicone insulators functioned in that they did not flash over, track, or puncture.

TABLE 1

| Test Result | A1 | A2 | A3 | A4 | S1 | S2 |
|---|---|---|---|---|---|---|
| Material | EPDM | EPDM | EPDM | EPDM | Silicone | Silicone |
| Flashover, months | 14,15,26 | — | 25,37,38 | 37,38 | — | — |
| Other Failure, months | | 11 | | | — | — |
| Terminated Test, months | 26 | 16 | 38 | 38 | —* | 87** |

*still under test after greater than 120 months
**Unit had not flashed over. Was removed from test for laboratory analysis of surface. Showed good water repellency and low surface contamination level.

EXAMPLE 2

Test insulators were prepared to evaluate the ability of a silicone elastomer insulation material of the type claimed herein to resist the effects of arcing caused by dry band formation during a long term, extended, tracking wheel test.

The core of the insulator was a fiberglass reinforced cycloaliphatic epoxy rod having a diameter of 0.67 inch. Standard metal high voltage end fittings were applied to each end of the core rod, with a distance of 7.5 inches between end fittings. An epoxy composition was molded over the core to form a layer of about 0.25 inch thickness. An integrally formed core cover and sheds were then molded over the core, using the silicone composition of Example 1. The core cover diameter was 1.25 inches. There were 4 sheds, having a diameter of 3 inches and a distance of 2 inches between each shed. The upper surface of the shed was at an angle of about 55 degrees to the core and the lower surface of the shed was at an angle of about 90 degrees to the core. The total leakage path distance between the end fittings was 12.5 inches. The design ratios for this insulator were:

$$\frac{D_s}{L_s} = \frac{3.0}{2.0} = 1.5$$

$$\frac{L_c}{L_a} = \frac{12.5}{7.5} = 1.7$$

$$\frac{D_s}{D_c} = \frac{3.0}{1.25} = 2.4$$

Four of these insulators were evaluated in a tracking wheel test. In this test, four insulators were mounted on a wheel by attaching one end of the insulator to the wheel so that the insulators were extended radially at right angles to each other. The wheel was rotated to position each insulator in a given location for 15 seconds. The travel time between positions was 15 seconds. The first position was the dip position. A dip tank was placed under the wheel so that the position submerged the insulator in a salt water solution in the tank. The salt water was heated to 30° C. and contained 1 percent sodium chloride to give a conductivity of 2000±500 microsiemens per centimeter.

The second position was the drip position. Excess saline solution was allowed to drip off the insulator. The dry bands are formed where the leakage current density is the highest. Usually this occurs along the shank of the insulator. Sparking across high current dry bands usually leads to tracking and/or erosion of the shed material.

The third position was the energized position. An electrical connection was made to the outer end of the insulator applying voltage across the insulator. During energization, sparking across dry bands concentrates along mold release lines, joints between sheds, and at the end seals. Heat produced from the sparking may result in tracking and/or erosion of the material. Tracking leads to failure along the surface of the insulator. Erosion may lead to water ingress and electrical failure along the rod-shed interface.

The fourth position was the cooling position. The shed material heated by the arcing was allowed to cool. Bonded portions of an insulator were thus subjected to thermal cycles.

Experience with many materials in this test procedure has established that 60,000 cycles is sufficient to discriminate superior designs from inferior ones at a stress level of approximately 0.5 kV/inch.

When the silicone insulators were tested under 20 kV test voltage (1.5 kV/inch), a flashover occurred after about 7000 cycles due to surface contamination. The test method requires cleaning of the insulator before the test is continued. If the insulator shows severe tracking or erosion, it is removed from the test. The insulator was cleaned and the test continued.

After the 80,000 cycles, the insulators were removed and cleaned and examined. There was no material damage evidenced by either erosion or tracking.

EXAMPLE 3

Test insulators were prepared to compare the methods of this invention to prior methods using epoxy compositions as the surface of the insulator.

An insulator was molded from a cycloaliphatic epoxy composition. The core was fiberglass reinforced with a diameter of 0.67 inch. Standard metal high voltage end fittings were applied to each end of the core, with a distance of 7.5 inches between them. Then the epoxy composition was molded over the core to form 7 equally spaced sheds having a diameter of 3.0 inches and a distance of 1.0 inch between each shed. The diameter of the cover over the core was 1.0 inch. The upper surface of the shed was at an angle of about 55 degrees to the core and the lower surface was at an angle of about 90 degrees to the core. The total leakage path distance between the end fittings was 16.25 inches. This is insulator A. A duplicate was made which is insulator D.

An epoxy insulator having a shorter leakage path was prepared by modifying the mold to eliminate three of the sheds, leaving four equally spaced sheds having a diameter of 3.0 inches and a distance of 2.0 inches between each shed. The sheds were the same size and shape as above. The total leakage path distance between the end fittings was 12.5 inches. This is insulator B. A duplicate was made which is insulator E. For this insulator, the design ratios were:

$$\frac{D_s}{L_s} = \frac{3.0}{2.0} = 1.5$$

$$\frac{L_c}{L_a} = \frac{12.5}{7.5} = 1.7$$

$$\frac{D_s}{D_c} = \frac{3.0}{1.25} = 2.4$$

A silicone insulator falling under the method of this invention was prepared by molding the composition of Example 1, using the four-shed mold described above to prepare the four-shed epoxy insulator. This is insulator C, the duplicate insulator is insulator F.

The six insulators were then tested in the fog chamber described above. The insulators were suspended in a circle in a vertical position around the center of the fog chamber. The top of the insulators were attached to a metal wheel, which was suspended at its center from the high voltage terminal. The bottom of each insulator was attached to ground, through the measuring system used to measure the current flow over the surface of each insulator during the test. The spray nozzles used to create the fog in the chamber were directed toward the center of the chamber. The water had a conductivity of 200 microSiemens per centimeter. The voltage was set at 20 kilovolts.

Table II shows the accumulated charge in coulombs during the test by hours. The leakage current of the silicone insulators was orders of magnitude less than that of the epoxy insulators, thus reducing the probability of flashovers.

TABLE II

| | Accumulated Charge, coulombs | | | | | |
|---|---|---|---|---|---|---|
| | A* | B* | C | D* | E* | F |
| Insulator Cover type | epoxy | epoxy | silicone | epoxy | epoxy | silicone |

TABLE II-continued

| | Accumulated Charge, coulombs | | | | | |
|---|---|---|---|---|---|---|
| | A* | B* | C | D* | E* | F |
| Number of sheds | 7 | 4 | 4 | 7 | 4 | 4 |
| Hours | | | | | | |
| 22 | 0.02 | 0.04 | 0.01 | 0.13 | 3.75 | 0.12 |
| 45 | 0.17 | 57.69 | 0.25 | 4.95 | 70.62 | 0.34 |
| 63 | 6.87 | 63.97 | 0.64 | 14.30 | 82.90 | 0.64 |
| 94 | 26.06 | 87.56 | 3.15 | 31.68 | 103.92 | 1.44 |
| 140 | 50.28 | 102.29 | 4.32 | 55.55 | 127.79 | 1.85 |
| 162 | 63.89 | 134.68 | 5.49 | 66.58 | 135.74 | 2.03 |
| 187 | 77.92 | 148.36 | 5.96 | 83.47 | 149.28 | 2.51 |
| 212 | 91.04 | 170.00 | 7.20 | 99.59 | 159.82 | 3.04 |
| 237 | 102.14 | 175.75 | 7.46 | 115.30 | 171.48 | 3.32 |
| 256 | 108.03 | 187.13 | 8.11 | 127.93 | 178.81 | 3.65 |

*comparative insulators
A and D are duplicates
B and E are duplicates
C and F are duplicates

EXAMPLE 4

The silicone elastomeric composition of Example 1 was evaluated in the form of one-inch diameter rods. This is Composition A in Tables III, IV, and V.

Comparative rods were also prepared. Composition B was an ethylene-propylene-dimer polymer filled with 120 parts by weight of aluminum trihydrate. Composition C was a silicone composition of 100 parts by weight of base and 120 parts by weight of aluminum trihydrate filler added to the base. The base was 100 parts by weight of polydiorganosiloxane gum having about 0.14 mol percent vinyl radicals and the rest methyl radicals with dimethylvinylsiloxy endblockers and a Williams plasticity of about 150, 7.5 parts by weight of hydroxyl endblocked polydimethylsiloxane fluid having a viscosity of about 0.04 Pa·s at 25° C. and about 4 weight percent silicon-bonded hydroxyl radicals as a treating agent for the filler, and 23 parts by weight of fumed silica having a surface area of about 250 $m^2/g$. The base was mixed and heated to treat the filler and remove volatile materials before the aluminum trihydrate was mixed into the base.

The composition was molded into rods, one inch in diameter. Pieces six inches long were fitted at each end with carbon disc electrodes by placing a stainless steel screw through the center of the disc into the end of the rods. The samples were then suspended in a circle in the center of the fog chamber by connecting the top electrode to a common high voltage bus. The fog chamber was a cubicle having 2.54 meter sides constructed from 3.2 mm thick Plexiglas sheet. The fog was created by nozzles which are constructed according to IEC Publication 507, 1975. The fog chamber had four nozzles placed equidistant on a pair of stainless steel tubes having an internal diameter of 7.94 mm and forming a ring of 2.54 m in diameter. A corrosion-resistant feed pump supplied salt water to the nozzles from a reservoir. The flow rate was adjusted to 0.58 MPa (80 psig). The water was recycled during the test. The test supply was a 14.4 kV/230 V, 37.5 kVA distribution transformer controlled by a 10 kVA, 0 to 208 V variac. The data acquisition system used was similar to that given in the paper "Evaluation of Polymer Systems for Outdoor H.V. Insulators Application by Salt-fog Chamber Testing", Reynart, Orbeck, and Seifferly, IEEE International Symposium of Electrical Insulation Conference, 1982. The output gave peak and average instantaneous current values on both the positive and negative half cycles. The current was integrated over the duration of the test to obtain the cumulative charge. The number of leakage current pulses between preset limits of current values was also obtained.

The six-inch long rods were subjected to a voltage of 9 kV rms to give a stress of 1.5 kV per inch. In a first test, the conductivity of the fog was 250 microsiemens per centimeter, obtained by using tap water. In a second test, the conductivity was 1000 microsiemens per centimeter, using sodium chloride to increase the conductivity. A test cycle consisted of 16 hours under fog and voltage stress, followed by 8 hours with no fog or voltage. The tests were carried out for 30 cycles. The test results are shown in Table III for the 250 microsiemens fog.

Rods evaluated using 1000 microsiemens fog at this voltage level were subjected to heavy arcing from the continuous dry band arcing that was going on. The heavy arcing causes tracking and erosion, depending upon the composition used. The silicone rod described here did not track or erode significantly when tested, other compositions having other filler loadings and types, as well as other types of polymer eroded to failure in this test. The test results are shown in Table IV for the 1000 microsiemens fog.

The surface composition of the rods was determined using an analytical technique known as X-ray-induced photoelectron spectroscopy, which is widely known as ESCA: Electron Spectroscopy for Chemical Analysis. In this technique, low energy electrons emitted by the specimen are analyzed to provide composition information in the one-to-ten atom layer region near the surface. A solid sample in a high vacuum system is irradiated with a high flux of X-rays. Core (inner-shell) electrons are ejected from all atoms in the sample, and analysis of the kinetic energy of these photo-ejected electrons provides information upon a number of important properties. The precise location of the measured peaks identifies not only the elements present, but also their chemical environment. This test determines the nature of a surface by its chemical composition. The results of a surface test of the rods after fog exposure is given in Table V. The silicone rods before exposure would have an analysis of approximately 25 percent oxygen, 25 percent silicon, and 50 percent carbon.

TABLE III

| from IRI 18-30 | | | |
|---|---|---|---|
| Test Property | | | |
| number of cycles | 10 | 20 | 30 |
| hours under stress | 160 | 320 | 480 |
| using 250 microsiemens fog | | | |
| Composition A | | | |
| Cumulative Charge, coulombs | 1,500 | 3,500 | 5,500 |
| Peak Current Pulses, >15 ma | none | none | 20,000 |
| Composition B | | | |
| Cumulative Charge, coulombs | 3,300 | 7,000 | fail* |
| Peak Current Pulses, >15 ma | 400,000 | 4,800,000 | fail* |
| Composition C | | | |
| Cumulative Charge, coulombs | 1,600 | 4,500 | 7,500 |
| Peak Current Pulses, >15 ma | 20,000 | 40,000 | 100,000 |

TABLE IV

| Test Property | | | |
|---|---|---|---|
| number of cycles | 10 | 20 | 30 |
| hours under stress | 160 | 320 | 480 |
| using 1000 microsiemens fog | | | |
| Composition A | | | |
| Cumulative Charge, coulombs | 8,000 | 16,000 | 24,000 |
| Tracking | none | none | none |

TABLE IV-continued

| | | | |
|---|---|---|---|
| Flashover | none | none | none |
| Weight Loss, percent | — | — | 2.75 |
| Composition B | | | |
| Cumulative Charge, coulombs | 8,000 | 16,000 | 24,000 |
| Tracking | | | some |
| Flashover | none | none | none |
| Weight Loss, percent | — | — | 3.5 |
| Composition C | | | |
| Cumulative Charge, coulombs | 8,000 | 16,000 | fail** |
| Tracking | none | none | none |
| Flashover | none | none | none |
| Weight Loss, percent | — | — | — |

*flashed over and tracked at 23 cycles
**eroded through at 22 cycles

TABLE V

| | Composition | | | | | |
|---|---|---|---|---|---|---|
| | % Na | % O | % Ca | % C | % Si | % Al |
| Composition A | | | | | | |
| 200 microsiemens | 0.0 | 29.5 | 0.0 | 48.9 | 20.4 | 0.9 |
| 1000 microsiemens | 0.1 | 27.7 | 0.0 | 52.0 | 18.8 | 1.2 |
| Composition B | | | | | | |
| 200 microsiemens | 0.2 | 34.3 | 4.7 | 54.5 | 3.7 | 2.6 |
| 1000 microsiemens | 0.5 | 36.5 | 1.0 | 50.2 | 7.4 | 4.3 |
| Composition C | | | | | | |
| 200 microsiemens | 0.1 | 30.5 | 1.3 | 51.5 | 14.8 | 1.8 |
| 1000 microsiemens | 0.0 | 33.7 | 0.2 | 44.4 | 20.2 | 1.1 |

A is silicone of this invention
B is EPDM
C is silicone not of this invention

The sodium and calcium would be expected to come from the salt-water fog. The aluminum comes from the aluminum trihydrate filler in the compositions. The silica on the EPDM must come from contaminants in the water during the test. If the amount of sodium and calcium are used as indicators, the test shows that the EPDM accumulates a higher amount of contaminant on its surface during both levels of fog contamination. This accumulation of pollutant may cause more leakage current and dry-band activity which may lead to flashover.

The track resistance was determined in accordance with ASTM D 2303 test of the American Society for Testing and Materials. The current edition is found in section 10 of the Annual Book of ASTM Standards. Because of the extreme water repellency of the silicone material, the test sample was turned over so that the contaminant solution flowed down the face of the test sample. The contaminant pump was operated at a rate of 8 strokes per minute, resulting in a flow of 0.60 ml/min. The voltage was set at 4.5 kV. The sample was tested under the time-to-track method. The silicone composition was molded into a slab having a thickness of about 0.075 inch for this test. The test was terminated after 4000 minutes as the sample had still not failed at that time.

That which is claimed is:

1. A high performance, high voltage electrical insulator, for use with voltages in excess of 15 kilovolts line to ground in an outdoor environment, comprising, (1) a non-conducting, fiber reinforced, polymeric support rod, (2) a metal support fitting attached securely to each end of the support rod, and (3) a continuous, arc-resistant, silicone elastomeric cover securely bonded to the support rod and each metal support fitting, the cover being shaped to provide at least one shed and so that the following ratios are present, $$\frac{D_s}{L_s} \text{ equal or less than } 1.5$$

$$\frac{L_c}{L_a} \text{ equal or less than } 1.7$$

$$\frac{D_s}{D_c} \text{ equal or less than } 3$$

where $D_s$ is shed diameter, $L_s$ is distance between equivalent positions on adjacent sheds, $L_c$ is leakage distance between the support fittings, $L_a$ is straight line distance between the support fittings, and $D_c$ is diameter of the cover over the support rod, the silicone elastomeric cover comprising a cured composition resulting from a composition comprising a mixture of (a) from 70 to 90 parts by weight of dimethylvinylsiloxy endblocked polydimethylsiloxane having a Williams plasticity number of greater than 50, (b) from 10 to 30 parts by weight of dimethylvinylsiloxy endblocked polydiorganosiloxane having about 98 mol percent dimethylsiloxane units and 2 mol percent methylvinylsiloxane units and a Williams plasticity number of greater than 25, (c) from 13 to 17 parts by weight of fumed silica having a surface area of greater than 50 $m^2/g$, and a treated surface which prevents reaction with (a) and (b), (d) from 1.5 to 2.5 parts by weight of hydroxyl endblocked polydiorganosiloxane having methyl and vinyl radicals and having about 10 weight percent vinyl radical and about 16 weight percent hydroxyl radical, and (e) from 90 to 220 parts by weight of aluminum trihydrate, the mixture having been heated at a temperature of at least 100° C. for a time of at least 30 minutes.

2. The insulator of claim 1 in which there are two or more sheds.

3. The insulator of claim 1 in which the sheds have parallel upper and lower surfaces.

4. The insulator of claim 1 in which the shed surfaces are at an angle of from 30 to less than 90 degrees to the center line of the core.

5. The insulator of claim 1 in which (a) is from 80 to 90 parts by weight of dimethylvinylsiloxy endblocked polydimethylsiloxane having a Williams plasticity number of about 80, (b) is from 10 to 20 parts by weight of dimethylvinylsiloxy endblocked polydiorganosiloxane having about 98 mol percent dimethylsiloxane units and 2 mol percent methylvinylsiloxane units and a Williams plasticity number of about 28, (c) is from 13 to 17 parts by weight of fumed silica having a surface area of about 250 $m^2/g$ and from 7 to 9 parts by weight of hydroxyl endblocked polydimethylsiloxane fluid having a viscosity of about 0.04 Pa·s at 25° C. and about 4 weight percent silicon-bonded hydroxyl radicals to treat the silica surface, (d) is from 1.5 to 2.5 parts by weight of hydroxyl endblocked polydiorganosiloxane having methyl and vinyl radicals and having about 10 weight percent vinyl radical and about 16 weight percent hydroxyl radical, and (e) is from 180 to 220 parts by weight.

6. The insulator of claim 5 in which (a) is 85 parts by weight.

7. The insulator of claim 5 in which (b) is 15 parts by weight.

8. The insulator of claim 5 in which (c) is 15 parts by weight of fumed silica and 8 parts by weight of hydroxyl endblocked polydimethylsiloxane.

9. The insulator of claim 5 in which (d) is 2 parts by weight.

10. The insulator of claim 5 in which (e) is 200 parts by weight.

* * * * *